United States Patent [19]

Fleck

[11] Patent Number: 4,462,646

[45] Date of Patent: Jul. 31, 1984

[54] INSULATED CABINET CONSTRUCTION FOR CHEST FREEZERS

[75] Inventor: George J. Fleck, Arnegard, N. Dak.

[73] Assignee: Whirlpool Corporation, Benton Harbor, Mich.

[21] Appl. No.: 428,415

[22] Filed: Sep. 29, 1982

[51] Int. Cl.[3] ..... F25D 11/00

[52] U.S. Cl. ..... 312/214; 312/140; 312/296

[58] Field of Search ..... 220/430-434, 220/467; 62/DIG. 13; 312/214, 2, 140, 296; 49/DIG. 1, 485, 478

[56] References Cited

U.S. PATENT DOCUMENTS

| | | | |
|---|---|---|---|
| 2,414,061 | 1/1947 | Richard et al. | 220/432 |
| 2,679,944 | 6/1954 | Morton | 220/431 |
| 2,729,863 | 1/1956 | Kurtz | 52/403 |
| 2,843,286 | 7/1958 | Pulaski | 220/433 |
| 2,986,301 | 5/1961 | Donnelly | 220/432 |
| 3,233,276 | 2/1966 | Swanson et al. | 16/431 |
| 3,380,615 | 4/1968 | Kessler | 220/433 |
| 3,489,477 | 1/1970 | Harder, Jr. | 312/214 |
| 3,768,687 | 10/1973 | Spencer | 220/433 |

*Primary Examiner*—William E. Lyddane
*Assistant Examiner*—Joseph Falk
*Attorney, Agent, or Firm*—Wood, Dalton, Phillips, Mason & Rowe

[57] ABSTRACT

An enclosure structure including a cabinet having an insulative wall defining an internal space selectively closed by a closure member hingedly mounted to the cabinet. The end of the insulating space in the wall is closed by a cooperating breaker collar, inner liner, and outer shell flange structure arranged to be free of protuberant portions for nonbinding, wiping movement of the closure gasket thereagainst in the selective positioning of the closure member between open and closed positions. In the illustrated embodiment, the shell flange includes a turned distal portion projecting downward with respect to the insulating space and the breaker collar includes a distal connecting portion embracing the turned distal portion of the flange to provide a positive connection of the breaker collar to the shell. The breaker collar is thusly effectively recessed relative to the shell flange to provide for free movement of the closure gasket without binding in moving to and from the closed position of the closure relative to the cabinet.

15 Claims, 4 Drawing Figures

INSULATED CABINET CONSTRUCTION FOR CHEST FREEZERS

BACKGROUND OF THE INVENTION

1. Field of the Invention

This invention relates to a cabinet construction and in particular to a breaker collar and shell flange joint for use in an insulated cabinet for a chest freezer.

2. Description of the Background Art

In one form of insulated cabinet construction, the cabinet defines an access opening which is selectively closed by a closure. Illustratively, in a chest freezer, the cabinet defines an upwardly opening cabinet wall structure with a closure lid hingedly mounted thereto for sealingly engaging a breaker collar and shell flange structure extending about the access opening.

A torsion bar hinge structure as disclosed in U.S. Pat. No. 3,233,276, Swanson et al., assigned to the same assignee as the present invention, is advantageous for attaching the closure lid to the cabinet wall structure for many reasons including the fact that passage of the cabinet through a narrow door opening is facilitated since the hinge structure is substantially contained within the closure or lid because no projections beyond the confines of the lid are required. However, a problem may arise in cabinet structure of this type unless provision is made so that on closing of the lid, the sealing gasket provided on the closure lid can sealingly slide against the joint between the breaker collar and shell flange on the access opening of the cabinet without tending to bind against the juncture portions.

One form of refrigerator breaker strip is illustrated in U.S. Pat. No. 2,679,944 of Evans T. Morton, wherein a number of breaker strips are provided, each having an enlarged end connected to the shell flange so as to define an outwardly projecting protuberance against which an element, such as a closure gasket, would tend to bind.

In U.S. Pat. No. 2,729,863, Lowell M. Kurtz discloses an insulated cabinet wherein the shell flange defines a planar wall and the breaker strip defines an inturned distal end underlying the inner end of the shell flange wall.

John W. Pulaski discloses, in U.S. Pat. No. 2,843,286, a refrigerator cabinet breaker strip in one form similar to the protuberant strip of Morton, as discussed above, and in another form similar to the inturned breaker strip form of Kurtz discussed above.

Michael H. Kessler discloses a refrigeration apparatus cabinet construction in U.S. Pat. No. 3,380,615 wherein the breaker strip is provided with bifurcated edge portions, one of which underlies the inturned shell flange in a manner similar to that of Kurtz.

In U.S. Pat. No. 3,768,687, Donald J. Spencer discloses a plastic breaker strip wherein the edge of the strip underlies the planar shell flange while extending in a substantially planar configuration.

SUMMARY OF THE INVENTION

The present invention comprehends an improved cooperating breaker collar-shell flange structure for use in an enclosure for effectively precluding hangup or binding of the closure gasket on a junction between the breaker collar and shell flange.

The invention comprehends the provision of an arrangement of the breaker collar and shell flange eliminating any projection of the breaker collar beyond the shell flange. Such structure is particularly advantageous in a chest freezer provided with a torsion bar hinge structure.

In the illustrated embodiment, the breaker collar connection is effected inwardly of the sealing portion of the shell flange.

More specifically, in the illustrated embodiment, the shell flange includes a turned distal end and the breaker collar includes a distal connecting portion connected to the shell distal end.

Further more specifically, the invention comprehends an improved enclosure structure including a cabinet defined by an insulative wall having an outer shell, an inner liner defining with the shell an intermediate insulating space, and thermal insulation in the space. Improved means are provided for closing an end of the space including an edge portion of the shell defining a flange having an outer portion extending partially across the end of the space toward the liner and having a turned distal end extending downward with respect to the space to terminate within the end of the space, and a breaker collar having a mounting portion secured to an edge portion of the liner at the end of the space and a distal portion secured to the turned distal end of the shell flange within the space whereby the closure sealing gasket may wipe against the connected shell flange and breaker collar for selective sealed engagement with the shell flange and breaker collar free of projection impediment.

In the illustrated embodiment, the end portion of the shell flange is inclined at an angle of less than 90° into the insulating space, and more specifically as shown, extends at an angle of approximately 30° with respect to horizontal.

In the illustrated embodiment, the breaker collar is recessed relative to the shell flange.

In the illustrated embodiment, the distal portions of the shell and liner project in embracing relationship into the end of the insulating space.

In the illustrated embodiment, the breaker collar distal portion defines an outwardly opening recess complementary to and sealingly receiving the turned distal end of the shell edge portion.

In the illustrated embodiment, the insulating space is filled with foamed-in-place insulation, the associated inturned shell flange distal portion and embracing breaker collar distal portion being embedded in the insulation.

Thus, the breaker collar is free of projection outwardly of the shell wall flange sealing portion to permit the closure sealing gasket to slide freely against the breaker collar and shell flange during movement of the closure to and from the closed position effectively avoiding binding or hangup of the gasket thereon.

The improved enclosure structure of the present invention is extremely simple and economical of construction while yet providing the highly desirable features discussed above.

BRIEF DESCRIPTION OF THE DRAWINGS

Other features and advantages of the invention will be apparent from the following description taken in connection with the accompanying drawing wherein.

DESCRIPTION OF THE PREFERRED EMBODIMENT

Figure 1:
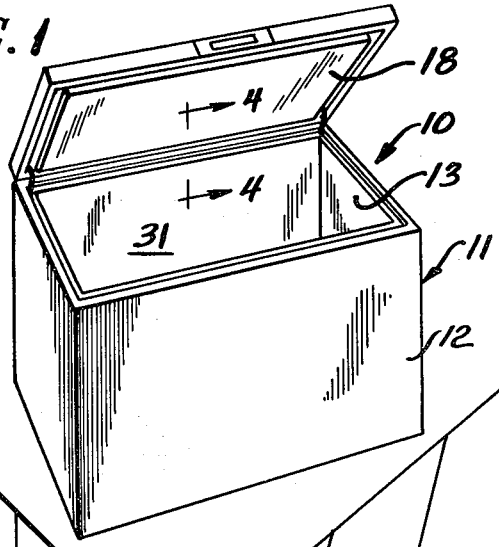
FIG. 1 is a perspective view of a chest freezer having an improved breaker collar-shell flange structure embodying the invention.
Figure 3:
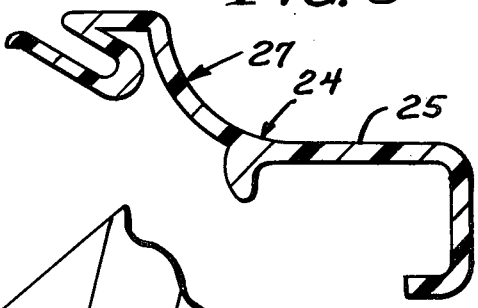
FIG. 3 is a horizontal sectional view of the breaker collar of the present invention taken along the line 3—3 of FIG. 2.
Figure 3:
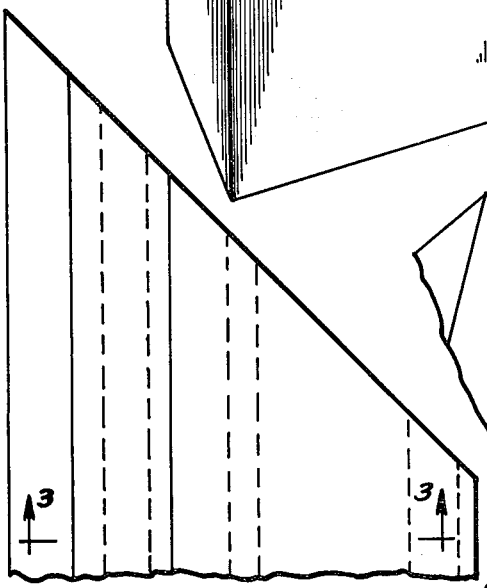

In the illustrative embodiment of the invention as disclosed in the drawing, an enclosure generally designated 10 is shown to comprise a cabinet 11 having an insulative sidewall defined by an outer shell 12, and inner liner 13, and foamed-in-place insulation 14 in the space 15 between the shell and liner. Closing means generally designated 16 are provided for closing an end of the space 17.

As further illustrated in FIG. 1, the cabinet defines, in the illustrated embodiment, an upwardly opening space 31 within liner 13. A closure lid 18 is hingedly mounted to the cabinet for selectively closing the space 31 by pivotal movement between a closed position wherein the closure sealingly engages the space closing means 16, and an open position, as shown in FIG. 1, wherein the space 31 is exposed for free access. The hinge structure 32 may advantageously be of the torsion-bar type shown in the aforementioned U.S. Pat. No. 3,233,276.

Figure 4:
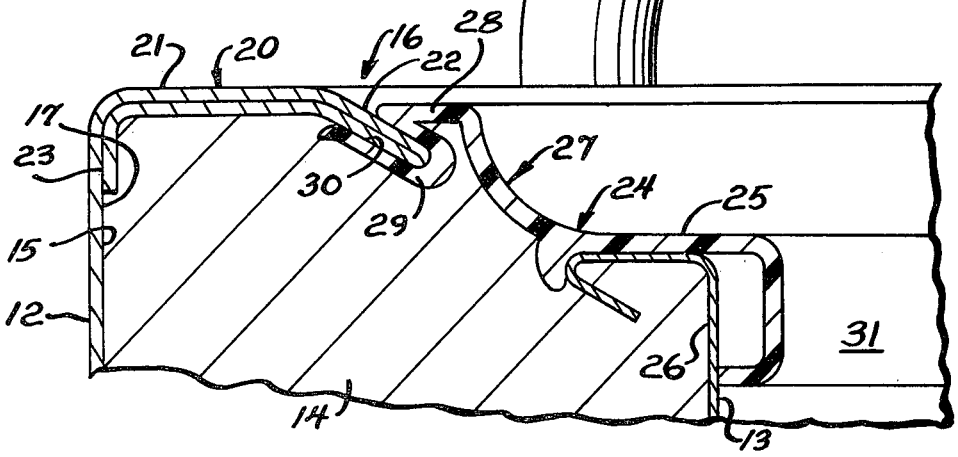
FIG. 4 is a fragmentary enlarged vertical section taken substantially along the line 4—4 of FIG. 1 illustrating the associated breaker collar-shell flange structure in greater detail.

As further illustrated in FIG. 4, closure 18 is provided with a peripheral sealing gasket 19 which projects downwardly from the closure toward structure 16. In the illustrated embodiment of the present invention, the hinged mounting of the closure to the cabinet by means of a hinge element 33 permits the gasket to wipe across the exposed surface of the closure structure 16 in moving to and from the closed position of the closure. Closing structure 16 is arranged in a novel manner to avoid binding of the gasket 19 as it so moves.

As best seen in FIG. 4, the closure structure 16 includes a flange edge portion 20 on the shell 12 having an outer planar portion 21 extending partially across the end 17 of space 15 toward liner 13. The distal end 22 of the shell flange extends into the end 17 of space 15. As shown, distal end 22 is inclined inwardly at an angle less than 90° to the planar portion 21 and, in the illustrated embodiment, extends at an angle of approximately 30° thereto. Further more specifically, in the illustrated embodiment, distal end 22 comprises a double thickness folded portion of the flange 20 which is returned fully back to the shell wall 12 and includes a downturned distal end 23 providing reinforcement of the flange.

Figure 2:
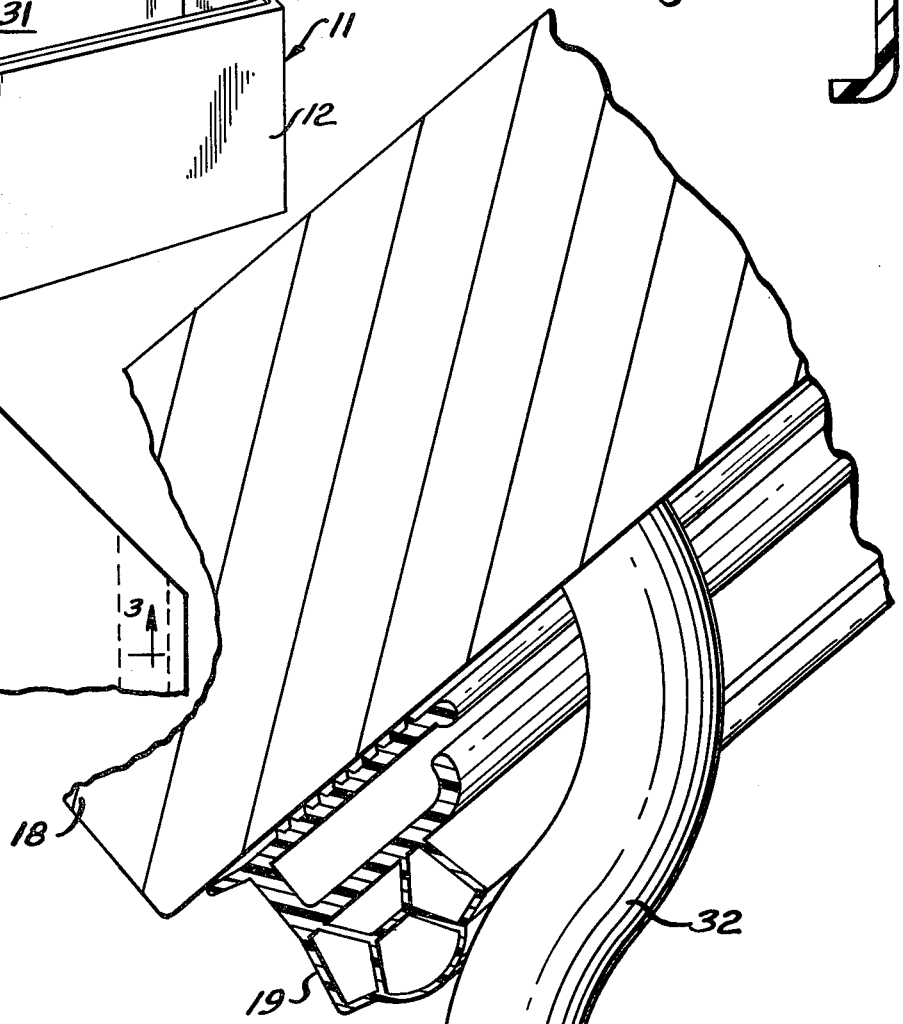
FIG. 2 is a fragmentary plan view of a portion of the improved breaker collar of the present invention.

Closing structure 16 further includes a breaker collar generally designated 24 having a mounting portion 25 secured to the edge portion 26 of liner 13 at insulation space end 17. The breaker collar further includes a distal connecting portion generally designated 27 defining a planar gasket-wiping surface portion 28 and a shell flange-embracing portion 29. As shown in FIG. 2, the connecting portion 27 is recessed relative to the flange portion 21, with gasket surface portion 28 being slightly recessed and spaced from the planar portion 21 by an outermost portion of the inclined distal end portion 22 of the shell flange, as best seen in FIG. 2.

The embracing portion 29 of the breaker collar connecting portion 27 defines an outwardly inclined recess 30 receiving the inclined distal portion 22 of the shell flange in connected embracing relationship. As shown, the connected shell flange portion 22 and embracing breaker collar portion 29 project downwardly with respect to the insulating space end portion 17 to be embedded in the insulation 14 as a result of the foamed-in-place formation of the insulation.

As a result of the novel arrangement of the cooperating shell flange and breaker collar structures, gasket 19 of the closure 18 may unimpededly wipe across the upwardly facing surface portions of breaker collar portion 28, shell flange portion 22, and shell flange portion 21 in moving to and from the closed position of the closure.

By virtue of the elongated U-shaped embracing relationship of the breaker collar portion 29 with the inclined distal end 22 of the shell flange, a positive retained association of the breaker collar with the shell flange is provided effectively preventing relative movement between the breaker collar and shell flange. Further, because of the folded double wall arrangement of the flange and the reinforcement effected by downturned distal end 23, a rigid sealing structure for cooperation with gasket 19 is provided on the cabinet.

In the illustrated embodiment, the breaker collar is formed as a one-piece element of molded synthetic resin. The shell conventionally is formed of sheet metal and, thus, the shell flange comprises a double wall thickness of the sheet metal forming the shell wall.

In the torsion bar hinge arrangement for hinging a chest freezer lid, the hinge point of the lid is forward of the final resting place of the lid gasket in its at rest position with the lid closed. Thus, there can be no protuberances beyond the flange surface portion 21 for proper gasket sealing action with no hang-ups. The present invention, by eliminating protuberances beyond the flange surface portion 21, permits the gasket 19 to move unimpededly as the lid is closed so as to provide an improved sealing engagement and release in the selective positioning of the cabinet closure.

The foregoing disclosure of specific embodiments is illustrative of the broad inventive concepts comprehended by the invention.

I claim:

1. In an enclosure structure including a cabinet defined by an insulative wall having an outer shell, an inner liner defining with said shell an intermediate insulating space, and thermal insulation in said space, said wall having an edge portion defining an access opening, and a closure movably mounted to the cabinet for selectively closing said access opening and having a projecting sealing gasket, improved means for closing an end of said space, comprising:

an edge portion of the shell defining a flange having an outer portion extending perpendicularly partially across said end of the space toward the liner and having a turned distal end extending angularly inwardly into said space to terminate within said end of the space; and a breaker collar having a mounting portion secured to an edge portion of the liner at said end of the space, a distal portion secured to said turned distal end of the shell flange within said end of the space and a gasket-wiping surface portion extending parallel to said flange outer portion within said space to be disposed inwardly of the plane of said flange outer portion, whereby said closure sealing gasket may wipe against the connected shell flange and said breaker collar surface portion for selective wiping sealed engagement therewith, with the shell flange and breaker collar being free of projection impediment to said sealed engagement.

2. The enclosure structure of claim 1 wherein said turned distal end of the shell flange extends at an angle of less than 90° into said insulating space.

3. The enclosure structure of claim 1 wherein said turned distal end of the shell flange extends at an angle of approximately 30° into said insulating space.

4. The enclosure structure of claim 1 wherein said breaker collar is recessed relative to said shell flange.

5. The enclosure structure of claim 1 wherein said distal portion of the shell and liner project in embracing relationship into said end of the insulating space.

6. The enclosure structure of claim 1 wherein said breaker collar distal portion defines an outwardly opening recess complementary to and sealingly receiving said turned distal end of the shell edge portion.

7. In an enclosure structure having an insulated cabinet defined by an outer shell wall, an inner liner wall, and insulation disposed in an insulative space between said walls, said cabinet defining an access opening, a closure, a sealing gasket in the closure projecting toward said cabinet, and means for hingedly mounting said closure to said cabinet for selectively positioning said closure in a closed position along said access opening and in an open position exposing said opening, improved means on the cabinet for engagement by said sealing gasket for sealing said closure to said cabinet in said closed position, comprising:

a flange on said shell wall having an outer sealing portion extending perpendicularly partially across said insulative space and a turned distal end inclined inwardly into said insulative space; and a breaker collar having an inner mounting portion mounted to said liner and extending partially across said insulation space, said breaker collar further having a gasket-wiping surface portion extending parallel to said flange outer portion within said space to be disposed inwardly of the plane of said flange outer portion, and a distal connecting portion embracing said distal end of the shell flange inwardly of said sealing portion thereof to be embedded in said insulation, said breaker collar being free of projection outwardly of said shell wall flange sealing portion to permit the closure sealing gasket to slide freely against said breaker collar surface portion and shell flange during movement of the closure to and from said closed position.

8. The enclosure structure of claim 7 wherein said shell wall flange sealing portion defines a planar outer sealing surface.

9. The enclosure structure of claim 7 wherein said shell wall flange distal end defines a planar outer surface.

10. The enclosure structure of claim 7 wherein said shell wall flange distal end comprises a double thickness folded wall portion.

11. The enclosure structure of claim 7 wherein said shell wall flange distal end comprises a double thickness folded wall portion including a turned distal edge portion at a juncture of said flange with the shell wall.

12. The enclosure structure of claim 7 wherein said shell wall flange distal end comprises a double thickness folded wall portion including a downturned distal edge portion at a juncture of said flange with the shell wall.

13. The enclosure structure of claim 7 wherein said breaker collar comprises a one-piece element formed of synthetic resin.

14. The enclosure structure of claim 7 wherein said connecting portion of the breaker collar defines a U-section, elongated pocket receiving said shell wall flange turned distal end.

15. The enclosure structure of claim 7 wherein the hinge point for the means for hingedly mounting said closure to said cabinet is forward of said sealing gasket in said closed position, the projection-free disposition of said breaker collar outwardly of said shell wall flange permitting said sealing gasket to move unimpededly to sealing position as said closure is closed.

* * * * *